US008181578B2

(12) United States Patent
Laurello et al.

(10) Patent No.: US 8,181,578 B2
(45) Date of Patent: May 22, 2012

(54) METHOD, SYSTEM AND DEVICES FOR RAILROAD TRACK RECONDITIONING AND REPAIR

(75) Inventors: Larry Laurello, Austinburg, OH (US); Paul Laurello, Austinburg, OH (US); Michael Laurello, Geneva, OH (US); Rick Ryel, Ashtabula, OH (US)

(73) Assignee: Delta Railroad Construction, Inc., Ashtabula, OH (US)

( * ) Notice: Subject to any disclaimer, the term of this patent is extended or adjusted under 35 U.S.C. 154(b) by 237 days.

(21) Appl. No.: 12/686,016

(22) Filed: Jan. 12, 2010

(65) Prior Publication Data

US 2011/0168796 A1 Jul. 14, 2011

(51) Int. Cl.
*E01B 29/00* (2006.01)

(52) U.S. Cl. ..... 104/5

(58) Field of Classification Search ..... 104/2–5, 104/7.1, 9, 10, 16, 17.1, 17.2; 238/264, 287, 238/297, 298, 310, 315, 321–324
See application file for complete search history.

(56) References Cited

U.S. PATENT DOCUMENTS

| | | | | |
|---|---|---|---|---|
| 3,496,883 | A | 2/1970 | Bodine | |
| 3,576,293 | A * | 4/1971 | Landis et al. | 238/287 |
| 3,881,422 | A | 5/1975 | Bryan | |
| 3,948,185 | A | 4/1976 | Setle et al. | |
| 4,018,165 | A | 4/1977 | Bryan | |
| 4,047,280 | A | 9/1977 | Dieringer et al. | |
| 4,464,995 | A | 8/1984 | Nameny | |
| 4,770,103 | A | 9/1988 | Allmer | |
| 4,794,861 | A | 1/1989 | Theurer et al. | |
| 4,844,338 | A * | 7/1989 | Bucksbee | 238/283 |
| 4,862,806 | A | 9/1989 | Theurer et al. | |
| 6,158,353 | A | 12/2000 | Theurer | |
| 6,463,858 | B2 | 10/2002 | Weber et al. | |
| 6,591,755 | B2 | 7/2003 | Theurer et al. | |
| 6,655,296 | B2 | 12/2003 | Theurer | |
| 6,863,717 | B2 | 3/2005 | Johnsen et al. | |
| 6,954,974 | B2 * | 10/2005 | Rada | 29/423 |
| 7,063,269 | B2 * | 6/2006 | Molyneux | 238/287 |
| 7,571,681 | B2 | 8/2009 | Haughey | |
| 7,578,239 | B1 | 8/2009 | Malek et al. | |
| 7,717,352 | B2 * | 5/2010 | Loffelsend et al. | 238/382 |
| 7,992,796 | B2 * | 8/2011 | Bednarczyk | 238/264 |
| 2008/0141894 | A1 | 6/2008 | Siano | |
| 2008/0302265 | A1 | 12/2008 | Theurer | |

* cited by examiner

*Primary Examiner* — S. Joseph Morano
*Assistant Examiner* — R. J. McCarry, Jr.
(74) *Attorney, Agent, or Firm* — Roetzel & Andress

(57) ABSTRACT

A method, system and devices for reconditioning, repair and replacement of railroad track components including direct fixation fasteners includes the use of temporary direct fixation fasteners which serve as temporary rail support and fastening and as guides for installation of permanent anchor inserts for installation and anchoring of new permanent direct fixation fasteners. The method of use of the temporary direct fixation fasteners enables operational use of the railroad line at various stages throughout reconditioning, repair and replacement processes.

38 Claims, 6 Drawing Sheets

METHOD, SYSTEM AND DEVICES FOR RAILROAD TRACK RECONDITIONING AND REPAIR

FIELD OF THE INVENTION

The present disclosure and related inventions is in the general field of railroads and more particularly railroad track construction, replacement and repair.

BACKGROUND OF THE INVENTION

Railroad track supports and guides the loads of locomotives and cars. The quality of the track determines the permissible wheel loads, speeds, safety and dependability. Track is generally constructed in the U.S. of rail segments which rest on tie plates supported by tics embedded in a substrate of rock fragments on a subgrade or roadbed. Track is also laid on a concrete bed with formed plinths which project upward from the foundation and support the tie plates and rails. Rail support varies in stiffness, and local deformations in the roadbed create widely varying dynamically applied loads which rapidly wear track components including rails, tie plates, tics, fastenings and ballast. For example, on a concrete rail bed, in addition to wear on the tie plates, tie plate anchor studs and rail clips, the supporting surface of the plinth becomes fractured and must be restored before installing new tie plates with new anchoring studs and rail clips. Restoration of the plinths is an expensive and time consuming process which requires removal of the rail section and tie plates, and reconditioning of the plinth bearing surface, which can keep the railroad out of service for an extended period of time.

SUMMARY OF THE INVENTION

The present disclosure and related inventions provides a new method, system and device for railroad track repair which greatly expedites the repair process, and which also enables the track to be readily placed back into operational use at different stages in the reconditioning or repair process. In accordance with one aspect of the disclosure and related inventions, there is provided a method of replacement of DF ("Direct Fixation") Fasteners of a railroad track wherein the DF Fasteners which support the rails of the railroad track are secured by nuts threaded on to existing anchor studs which extend upward from a substrate, the method including the steps of: filling a rail from the supporting DF Fastener; removing the DF Fastener from the existing anchor studs and the substrate; installing temporary DF Fasteners on the existing anchor studs and on the substrate by positioning the temporary DF fastener so that the existing anchor studs extend through existing anchor stud openings in the temporary DF Fasteners, and securing the temporary DF Fastener by nuts to the existing anchor studs; forming permanent anchor insert holes into the substrate by passing a drill through the temporary DF Fasteners permanent anchor insert openings, and installing permanent anchor inserts in the permanent anchor insert holes in the substrate by passing the permanent anchor inserts through the permanent anchor insert openings in the temporary DF Fastener. Advantageously, by use of the temporary DF Fastener in accordance with the method, the railroad track can be placed into operational service at or between the various stages of reconditioning or repair.

In accordance with another aspect of the disclosure and related inventions, there is provided a method of replacing existing DF ("Direct Fixation") Fasteners attached to rails of a railroad, wherein each existing DF Fastener is supported by a substrate and anchored to the substrate by fasteners on existing anchor studs and attached to the rails by clips, the method comprising the steps of: removing the DF Fastener from rails by removing the nuts from the existing anchor studs and removing the clips from the rails; installing temporary DF Fasteners on the substrate by fastening the temporary DF Fasteners to the existing anchor studs by use of nuts, and clipping the rails to the temporary DF Fastener by installation of clips which extend from the temporary DF Fastener to the rails supported by the temporary DF Fasteners; forming holes in the substrate for permanent anchor inserts by inserting a drill through the permanent anchor insert location holes in the temporary DF Fasteners; installing permanent anchor inserts in the substrate by inserting the permanent anchor insert through the permanent anchor insert location holes in the temporary DF Fastener; removing the temporary DF Fastener from the substrate by removing the nuts from the existing anchor studs, and removing the temporary DF Fasteners from the rails; eliminating the existing anchor studs from above the surface of the substrate; placing permanent DF Fasteners on the substrate and over the permanent anchor inserts, and fastening the permanent DF Fastener to the permanent anchor inserts by tightening permanent bolts into the permanent anchor inserts, and attaching the rails to the permanent DF Fastener by installation of permanent DF Fastener clips.

Also disclosed is a system for railroad track reconditioning and repair which includes the use of temporary DF Fasteners which also function as guides for formation of permanent anchor insert holes, and which enable operational use of the track between various steps of stages of the reconditioning or repair process.

DETAILED DESCRIPTION OF PREFERRED AND ALTERNATE EMBODIMENTS

Figure 1:
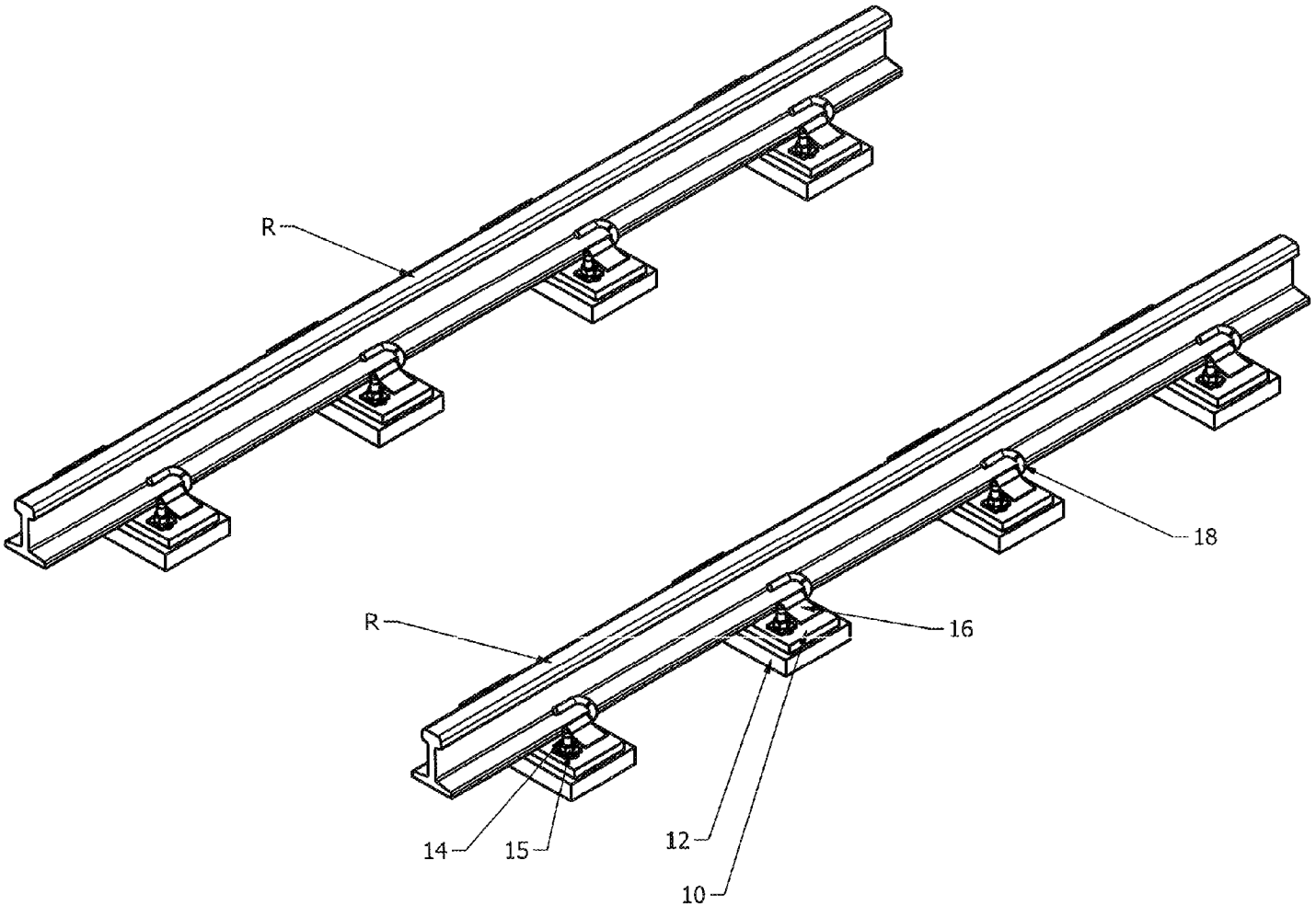
FIG. 1 is a perspective view of a representative railroad track.

FIG. 1 illustrates parallel rails R of a track or railroad, wherein the rails R rest on existing DF Fasteners 10 which are mounted upon concrete plinths 12 which project from a concrete base or road bed. The plinths 12 are representative of one type of substrate or foundation or rail bed for supporting the DF Fastener, and are also referred to generally herein as "substrate". Although described with reference to plinths 12, it is understood that the disclosure and related inventions are usable with a wide variety of substrates and support structures for railroad tracks and railways. Threaded existing anchor studs 14 (existing anchor studs") are embedded in the plinths 12 and extend upward through the existing DF Fastener 10. As used herein, the adjective "existing" in reference to the existing DF Fastener 10 and existing anchor studs 14 is merely nomenclature for the DF Fastener and anchor studs which exist on the railroad prior to the described procedures and devices. Nuts 15 (also referred to herein as "fasteners") are tightened on the existing anchor studs 14 to hold the existing DF Fastener 10 in place upon the plinths 12. The DF Fasteners 10 have two shoulders 16 for receiving rail securing clips 18, such as Pandrol® or Air Boss™ type clips which hold the rails R in place upon the top surface of the existing DF Fastener 10. Any other type of clip or clips which are configured to extend from the DF Fastener 10 to the rail R can be used.

Figure 2:
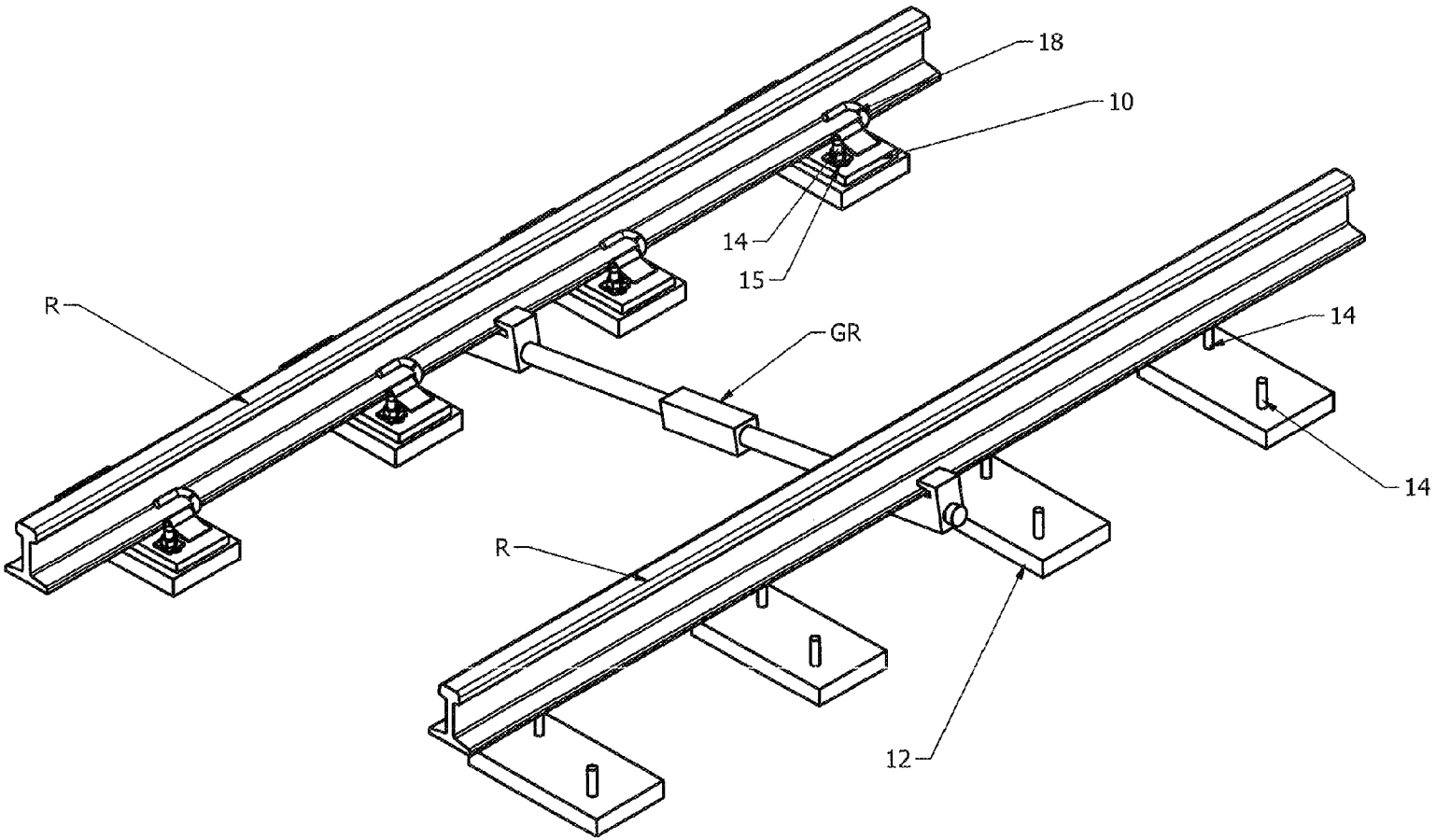
FIG. 2 is a perspective view of the railroad track of FIG. 1 in a phase of reconditioning or repair.

For reconditioning and repair of the plinths 12, the rail R is elevated by removal of the nuts 15 from the existing anchor studs 14, and the existing DF Fasteners 10 are removed from the plinths 12 off of existing anchor studs 14, and removed from the rail by removal of the rail securing clips 18, as shown in FIG. 2. Gauge rods GR may be installed with the parallel rail R prior to removal of the existing DF Fastener 10 from the plinths 12 in order to maintain the gauge of the track.

With the existing DF Fasteners 10 removed, the top surface of the plinths 12 is exposed for reconditioning or repair, such as by grinding, filling and sealing, or marked for enlargement or replacement. The railroad line remains out of service during the repair and reconditioning of the plinths 12, and would remain out of service without the present inventions until re-installation or replacement of the existing DF Fasteners 10 and re-fastening of the rails. In order to avoid a long period of service interruption, the present disclosure and related inventions include the use of a temporary DF Fastener 20 which can be used in place of existing DF Fasteners 10 to put the line back in service until the next steps in the reconditioning or repair process can be performed.

Figure 3B:
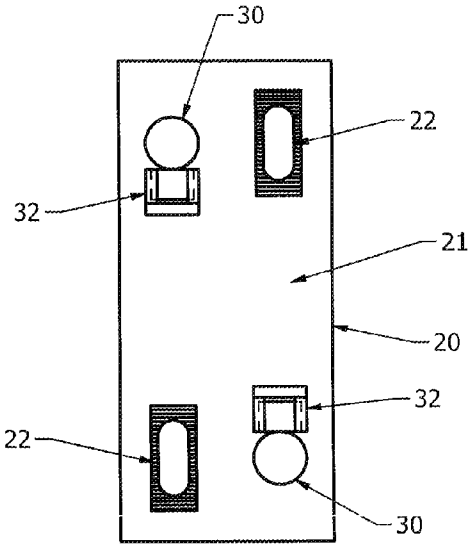
FIG. 3B is a top view of a temporary DF Fastener of the disclosure.
Figure 3A:
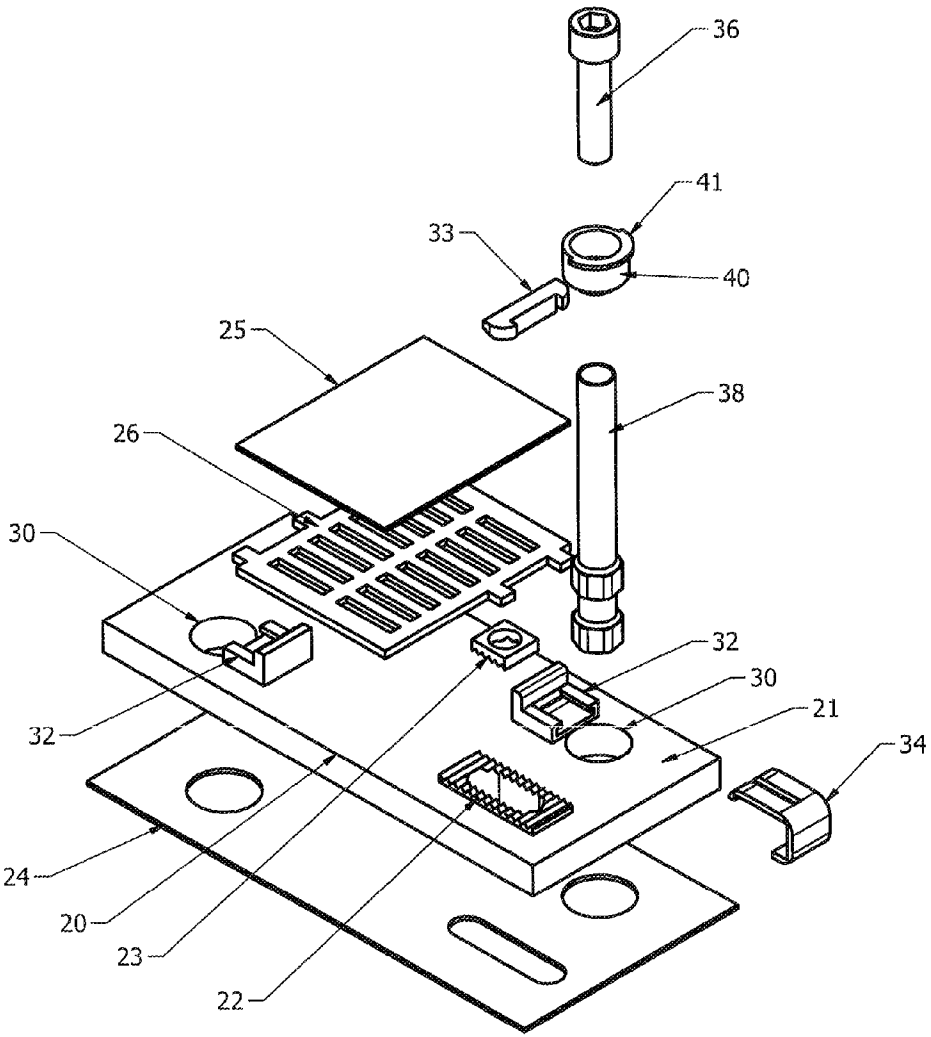
FIG. 3A is an assembly diagram of a temporary DF Fastener installation assembly of the disclosure.
Figure 4:
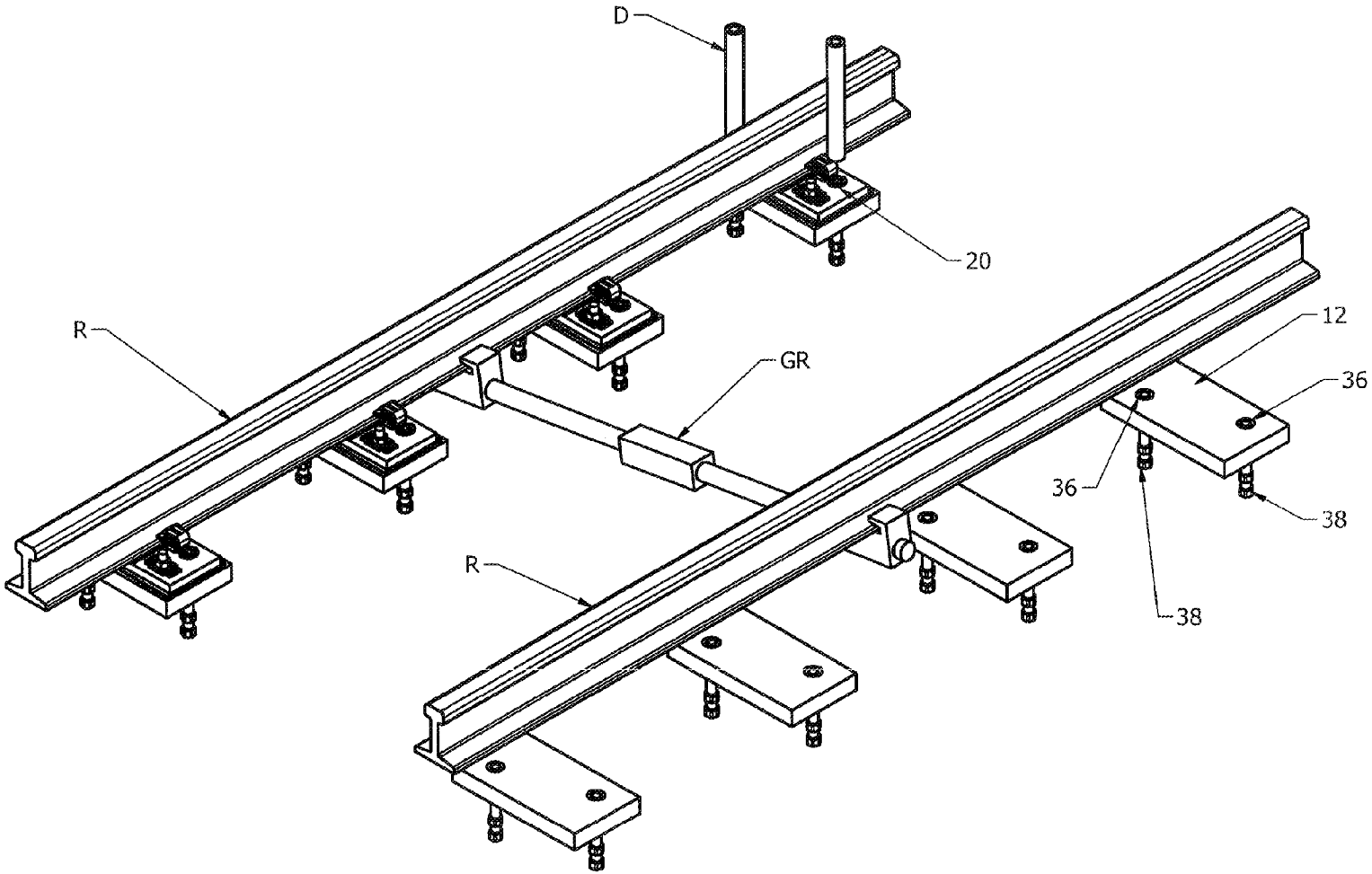
FIG. 4 is a perspective view of the railroad track of FIG. 1 in a phase of reconditioning or repair.

As shown in FIGS. 3 and 4, the temporary DF Fastener 20 (or "TIP 20" (acronym for "Temporary Installation Plate")) has a main body 21 which in this particular embodiment is generally rectangular and of similar dimensions to the existing DF Fasteners 10, and in this regard the body and underlying footprint of the TIP 20 can be made the same as or similar to any existing DF Fastener for which it will serve as a temporary substitute. Through the body 21 of the TIP 20 are two formed stud openings 22 ("existing anchor stud openings") located for receiving the existing anchor studs 14 of the rail installation, so that the existing anchor studs 14 pass through the TIP 20. The existing anchor stud openings 22 on the TIP 20 can be made oversized or elongated as shown in order to enable precise placement of the TIP 20 with respect to the plinth 12 or other substrate. An area around the existing anchor stud openings 22 can be raised and grooved, to fit with a mating grooved washer or spacer 23. The temporary DF Fastener 20 can thus be positioned over and fastened down by the nuts 15 on the existing anchor studs 14, and the rail R installed over the TIP 20 to put the line back into use. A pad 24 can be installed under the TIP 20, and additional pads 25 and 26 can be optionally positioned over the rail-bearing top surface of the TIP 20 and under the rail.

Also formed in the main body 21 of the TIP 20 are two permanent anchor insert openings 30 which are generally opposed to the existing anchor stud openings 22 and also located on opposing sides of the rail supporting surface of the TIP 20. In this embodiment, a clip shoulder 32 is formed proximate to each permanent anchor insert opening 30 and configured to receive a clip 34 to secure the rail base to the TIP 20. Any type of shoulder and clip configuration can be used in connection with the TIP 20. An insulator 33, can also be installed if needed between the clip 34 and the base of the rail R if needed.

With the TIP 20 secured to the rails by clips 34 and secured to the plinths 12 by the nuts 15 on the existing anchor studs 14, the line is fully functional and operational in a state wherein the plinths 12 have been reconditioned, repaired, enlarged or replaced, and the existing DF Fasteners have been removed. The use of the TIP 20 in the described manner enables placement of the line back into operational service for as long as possible, until the next phase of the line reconditioning and repair can be performed.

The TIP 20 also enables installation of permanent anchor inserts 38 to be located in the positions of the permanent anchor insert openings 30 in the TIP 20, without removal of the rail from the TIP 20. The permanent anchor inserts 38 are in this particular embodiment in the form of an assembly which includes a threaded permanent anchor insert which receives a temporary bolt, as further described. With the TIP 20 remaining fastened to the plinth 12 by the existing anchor studs 14, the permanent anchor insert openings 30 serve as guide holes for borings for permanent anchor inserts 38 as further described. The clips 34 are removed so access to the permanent anchor insert openings 30 is clear. A core drill D is inserted through the permanent anchor insert opening 30 (and through the corresponding opening in the underlying pad) and drills directly into the plinth 12. The drill bit can be aligned with the walls of the permanent anchor insert opening 30. Also, the drill may be mounted on or supported by the rail R which is supported by the TIP 20 for stability and reference. The bottom of the hole thus formed can be squared with a rock drill and the side walls scored, and the hole cleaned out and otherwise appropriately prepared for epoxy bonding. Once the holes are formed in the locations of each of the permanent anchor insert openings 30, the clips 34 can be re-installed if it is desired to put the line back into operational service.

Figure 5:
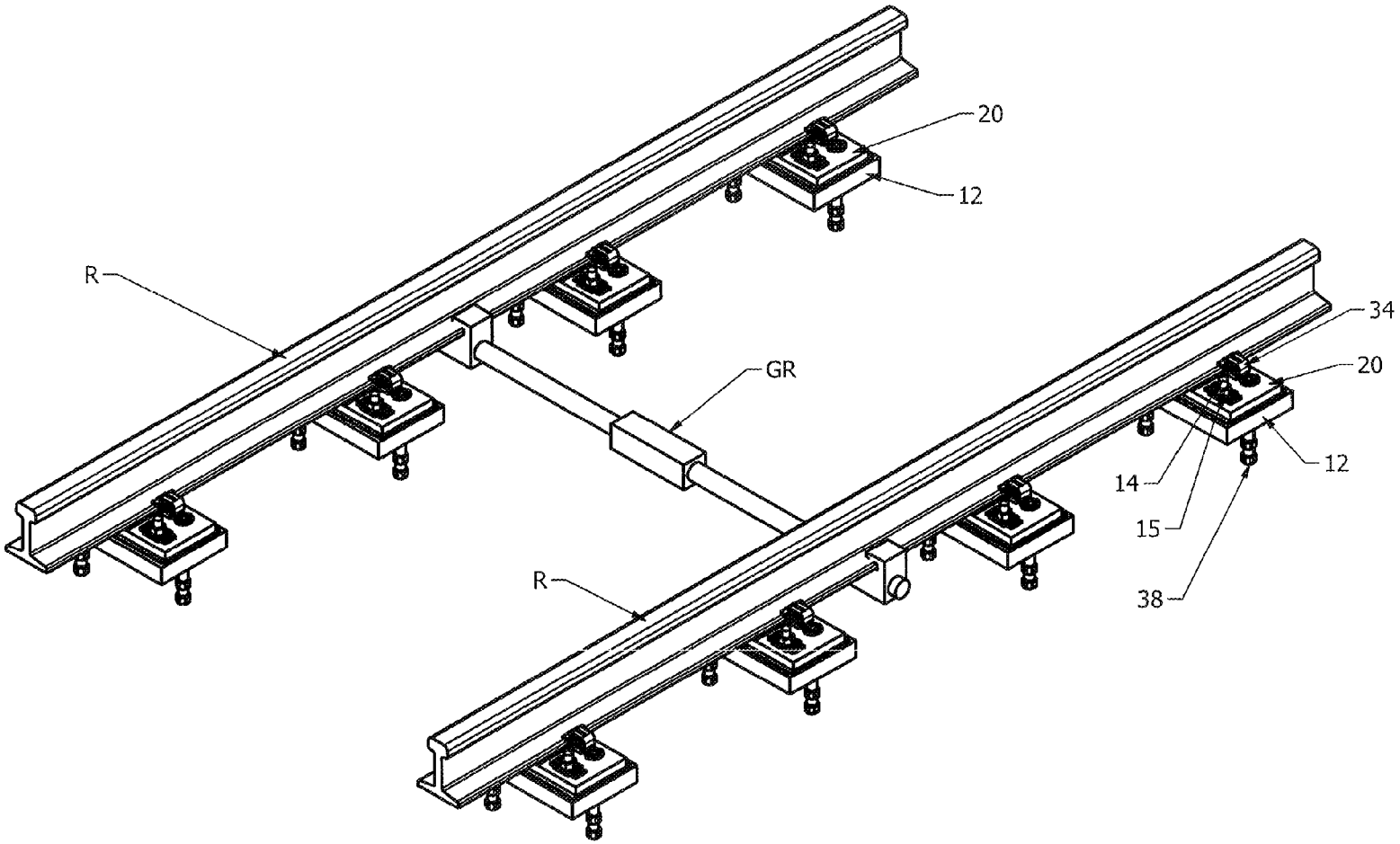
FIG. 5 is a perspective view of the railroad track of FIG. 1 in a phase of reconditioning or repair.
Figure 6:
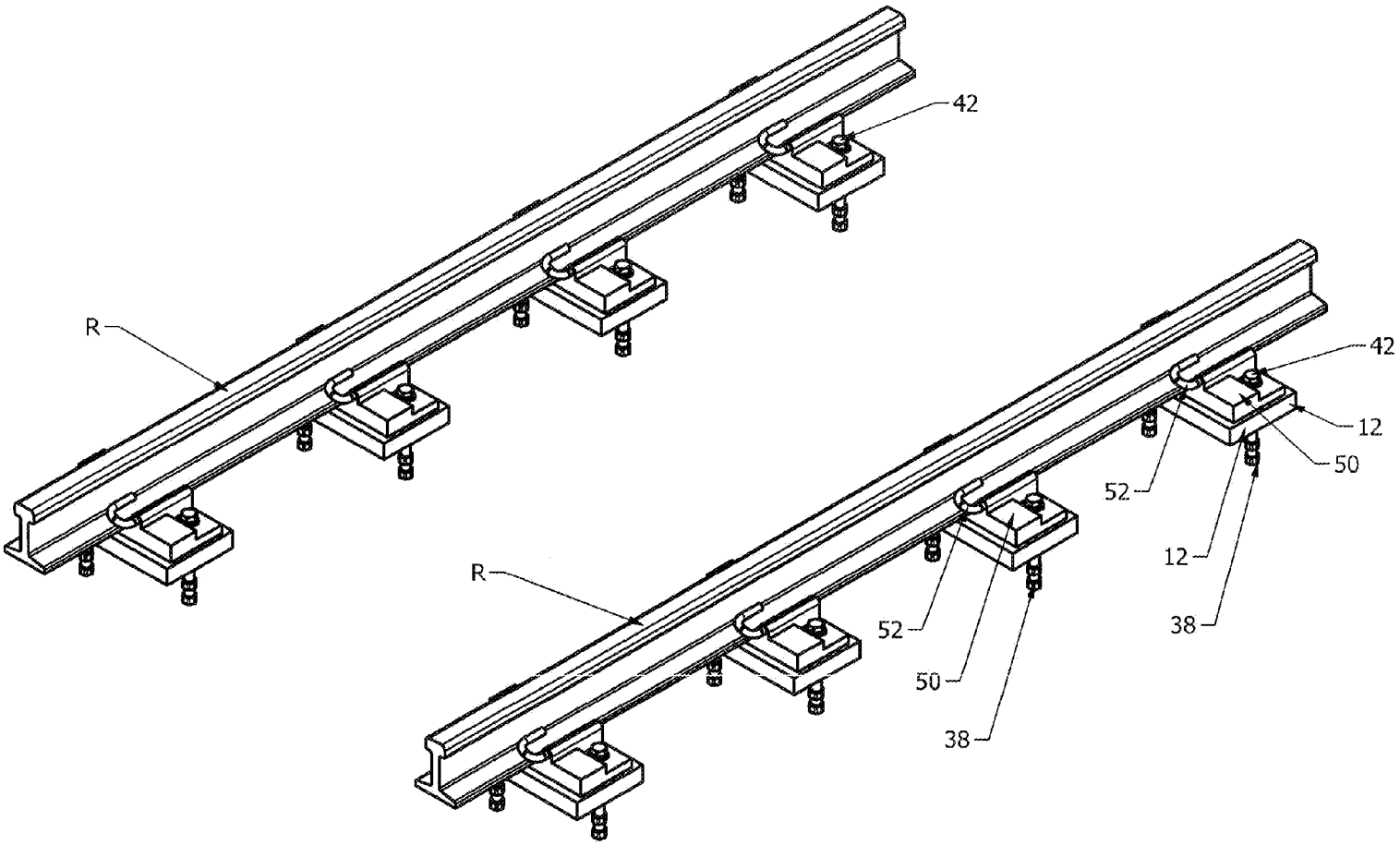
FIG. 6 is a perspective view of the railroad track of FIG. 1 in a completed state.

With the holes for the permanent anchor inserts properly prepared, permanent anchor inserts 38 can be installed in the holes, for example in epoxy which forms a bond between the permanent anchor inserts 38 and the surfaces of the hole. The permanent anchor inserts 38 are in this particular embodiment in the form of a bolt-receiving cylinder with internal threads, with an external configuration designed to mechanically bond with epoxy between the shaft and the hole surfaces, and internal threads for engagement with external threads of a temporary bolt 36 which is tightened into the permanent anchor insert 38. The permanent anchor inserts 38 are positioned in the permanent anchor insert openings 30 by a temporary positioning collar 40 which fits with the top end of the permanent anchor insert 38. Temporary bolt 36 is threaded into the permanent anchor insert 38 and captures the temporary positioning collar 40 at the top of the permanent anchor insert 38. The permanent anchor insert 38 is inserted through the permanent anchor insert opening 30 and into the new bore in the plinth 12. The exterior surface of the temporary positioning collar 40 bears against the permanent anchor insert opening 30 in the TIP 20, and a flange 41 at the top of the temporary positioning collar 40 is supported by contact with a top surface of the TIP 20 at the periphery of the permanent anchor insert opening 30, thus centering and suspending (if desired) the permanent anchor insert 38 in the bore, and more specifically within epoxy in the bore which will bond the permanent anchor insert 38 in the plinth 12 at the location of the permanent anchor insert opening 30. The temporary bolt 36 is thread engaged with the permanent anchor insert 38 and temporary positioning collar 40 so that the top of the bolt and the flange 41 are substantially flush with the top of the TIP 20, as shown in FIG. 4. In this configuration the clips 34 can be re-installed if desired to put the line again back in service during the epoxy cure period and thereafter, as shown in FIG. 5. Other forms of anchoring studs can of course be employed with the TIP 20, such as for example a bolt head which engages directly with the permanent anchor insert opening of the TIP 20 and/or top surface of the TIP 20.

Once the permanent anchor inserts 38 are fully cured in the epoxy, the strength of the bond can be tested by removing the temporary bolts 36 and the temporary positioning collar 40 and engaging a pull-out strength tester to the permanent anchor inserts 38. A torque test can also be performed by engagement of a threaded test stud with the internal threads of the permanent anchor insert 38. If the permanent anchor inserts 38 pass these tests, the TIP 20 can be removed from the plinth 12 by disengagement with the existing anchor studs 14. The existing anchor studs 14 are cut off and ground down and sealed. New permanent DF Fasteners 50 are installed with anchor through-holes located over the permanent anchor inserts 38, and new threaded permanent bolts 42 are engaged with the internal threads of the permanent anchor insert 38 (in place of temporary bolt 36). The rails R are positioned over the permanent DF Fastener 50 and clipped in place by permanent clips 52.

The disclosure and related inventions thus provide an entirely new method, system and device for railroad reconditioning or repair or replacement in which the successive steps can be performed in stages, between which the line can be placed into fully operational service, thus avoiding the need to keep the line out of service for the entire duration of the reconditioning or repair process. The TIP 20 and its use in the reconditioning or repair methods facilitates the recondition or repair of the substrate or plinths 12, and the installation of the permanent anchor inserts by insuring precise location and bonding of the permanent anchor inserts, and further enables operational use at different stages of the line during the reconditioning or repair process, for as long as possible. The use of the described pads 24, 25 and 26 in connection with the TIP 20 provides vibration dampening for optimal rail performance comparable to that with permanent DF Fasteners.

The disclosure and related inventions thus provide a much improved and cost efficient manner of railroad repair and reconditioning which avoids taking a line out of service for an extended period of time, as would otherwise be required. With the temporary DF Fasteners 20 serving as both functional and structural components of the track for regular use, and as guides or templates for the proper installation of permanent DF Fasteners, the dual functions of regular track use and ongoing repair or reconditioning is accomplished. Although described with reference to particular preferred and alternate embodiments, variations and modifications of the components and methodology within the skill of those in the art are within the scope and equivalent scope of the claims.

What is claimed as the invention is:

1. A method of replacing existing direct fixation fasteners attached to rails of a railroad, wherein each existing direct fixation fastener is supported by a substrate and anchored to the substrate by nuts on existing anchor studs and attached to the rails by clips, the method comprising the steps of:

removing the existing direct fixation fasteners from rails by removing the nuts from the existing anchor studs and removing the clips from the rails;

installing temporary direct fixation fasteners on the substrate by securing the temporary direct fixation fasteners to the existing anchor studs by use of nuts, and clipping the rails to the temporary direct fixation fasteners by installation of clips which extend from the temporary direct fixation fasteners to the rails supported by the temporary direct fixation fasteners;

forming holes in the substrate for permanent anchor inserts by inserting a drill through permanent anchor insert openings in the temporary direct fixation fasteners;

installing permanent anchor inserts in the substrate by inserting the permanent anchor inserts through the permanent anchor insert openings in the temporary direct fixation fasteners;

removing the temporary direct fixation fasteners from the substrate by removing the nuts from the existing anchor studs, and removing the temporary direct fixation fasteners from the rails;

eliminating the existing anchor studs from above the surface of the substrate;

placing permanent direct fixation fasteners on the substrate and over the permanent anchor inserts, and fastening the permanent direct fixation fasteners to the permanent anchor inserts by engaging and tightening permanent bolts with the permanent anchor inserts, and attaching the rails to the permanent direct fixation fasteners by installation of clips which extend from the permanent direct fixation fasteners to the rails.

2. The method of claim 1 further comprising the step of placing a temporary positioning collar about each of the permanent anchor inserts, and placing the temporary positioning collar in contact with the permanent anchor insert openings in the temporary direct fixation fasteners, whereby the permanent anchor insert is held in position in the permanent anchor insert hole by the temporary direct fixation fastener and the temporary positioning collar.

3. The method of claim 2 further comprising the step of bonding the permanent anchor insert to the permanent anchor insert hole with epoxy while the permanent anchor insert is held in position in the permanent anchor insert hole by the temporary direct fixation fastener and the temporary positioning collar.

4. The method of claim 1 further comprising the step of installing one or more gauge rods between parallel rails of a railroad prior to removing existing direct fixation fasteners from the rail.

5. The method of claim 1 further comprising the step of positioning each of the temporary direct fixation fasteners on the substrate by adjustment of the position of the temporary direct fixation fasteners relative to the existing anchor studs.

6. The method of claim 1 further comprising the step of installing a pad under each temporary direct fixation fastener between a bottom surface of the temporary direct fixation fastener and the substrate under the temporary direct fixation fastener.

7. The method of claim 1 further comprising the step of installing at least one pad over a rail supporting surface of the temporary direct fixation fastener.

8. The method of claim 1 wherein the step of clipping the rails to the temporary direct fixation fasteners is performed by engaging clips with clip shoulders on the temporary direct fixation fasteners and placing the clips in contact with a base of the rails.

9. The method of claim 8 further comprising the step of installing an insulator between the clip and the base of the rails.

10. The method of claim 1 further comprising the step of aligning a drill for forming holes in the substrate for the permanent anchor inserts with side walls of the permanent anchor insert openings in the temporary direct fixation fasteners.

11. The method of claim 10 wherein a portion of the drill is placed in contact with a rail which is supported by the temporary direct fixation fastener through which a drill bit of the drill is passed to form a hole in the substrate for a permanent anchor insert.

12. The method of claim 1 further comprising the step of installing epoxy in the holes for the permanent anchor inserts prior to insertion of the permanent anchor inserts in the permanent anchor insert holes.

13. The method of claim 2 further comprising the step of installing epoxy in the holes for the permanent anchor inserts prior to insertion of the permanent anchor inserts in the permanent anchor insert holes.

14. The method of claim 1 further comprising the step of using the railroad in operation with the rails supported by and clipped to the temporary direct fixation fasteners.

15. The method of claim 1 further comprising the step of removing the clips from the temporary direct fixation fasteners prior to forming the holes in the substrate for the permanent anchor inserts.

16. The method of claim 1 further comprising the step of reconditioning or repairing or replacing the substrate prior to or after installation of the temporary direct fixation fasteners.

17. The method of claim 1 further comprising the step of using the railroad in operation with permanent anchor insert holes formed in the substrate.

18. The method of claim 1 further comprising the step of using the railroad in operation with permanent anchor inserts installed in the substrate.

19. The method of claim 2 further comprising the step of using the railroad in operation with permanent anchor inserts installed in the substrate.

20. The method of claim 1 further comprising the step of cutting the existing anchor studs at or below a surface of the substrate.

21. The method of claim 20 further comprising the step of sealing ends of the existing anchor studs proximate to a surface of the substrate.

22. The method of claim 1 further comprising the step of removing the temporary bolts from permanent anchor inserts prior to placing the permanent direct fixation fastener on the substrate and over the permanent anchor inserts.

23. The method of claim 2 further comprising the step of removing the temporary positioning collar prior to placing the permanent direct fixation fastener on the substrate and over the new permanent anchor inserts and prior to tightening the bolts with the permanent anchor inserts.

24. A method of replacement of existing direct fixation fasteners of rails of a railroad track wherein the existing direct fixation fasteners which support the rails of the railroad track are secured by nuts threaded on to existing anchor studs which extend upward from a substrate, the method comprising the steps of:

lifting a rail from the existing direct fixation fasteners;

removing the existing direct fixation fasteners from the existing anchor studs and the substrate;

installing temporary direct fixation fasteners on the existing anchor studs and on the substrate by positioning the temporary direct fixation fasteners so that the existing anchor studs extend through existing anchor stud openings in the temporary direct fixation fasteners, and securing the temporary direct fixation fasteners by use of nuts to the existing anchor studs;

forming permanent anchor insert holes in the substrate by passing a drill through permanent anchor insert openings in the temporary direct fixation fasteners, and installing permanent anchor inserts in the permanent anchor insert holes in the substrate by passing the permanent anchor inserts through the permanent anchor insert openings in the temporary direct fixation fasteners.

25. The method of claim 24 further comprising the step of securing a rail to the temporary direct fixation fasteners by clips which extend from the temporary direct fixation fasteners to the rail prior to formation of the permanent anchor insert holes in the substrate.

26. The method of claim 24 further comprising the step of securing a rail to the temporary direct fixation fasteners by clips which extend from the temporary direct fixation fasteners to the rail after formation of the permanent anchor insert holes in the substrate.

27. The method of claim 24 further comprising the step of securing a rail to the temporary direct fixation fasteners by clips which extend from the temporary direct fixation fasteners to the rail after formation of the permanent anchor insert holes in the substrate and after installation of permanent anchor inserts in the permanent anchor insert holes.

28. The method of claim 24 wherein the step of installing permanent anchor inserts in the permanent anchor insert holes in the substrate by passing the permanent anchor inserts through the permanent anchor insert openings in the temporary direct fixation fasteners further comprises the step of installing the permanent anchor inserts in epoxy in the permanent anchor insert holes.

29. The method of claim 24 wherein the step of installing permanent anchor inserts in the permanent anchor insert holes further comprises the step of suspending the permanent anchor inserts in the permanent anchor insert holes by using a temporary bolt in the permanent anchor inserts, with a head of the temporary bolt supported by the permanent anchor insert opening in the temporary direct fixation fastener.

30. The method of claim 29 further comprising the step of installing a temporary positioning collar on the permanent anchor insert prior to insertion into the permanent anchor insert hole and through the permanent anchor insert opening in the temporary direct fixation fastener, and locating the temporary positioning collar in the permanent anchor insert opening in the temporary direct fixation fastener.

31. A system for reconditioning or repair of a railroad track having rails attached to existing direct fixation fasteners supported by a substrate and for repair or replacement of the existing direct fixation fasteners, the system comprising temporary direct fixation fasteners configured to be temporarily installed upon existing anchor studs and in place of the existing direct fixation fasteners, the temporary direct fixation fasteners having openings for the existing anchor studs, a rail bearing surface, openings for permanent anchor inserts, and clip shoulders for attachment of clips between the temporary direct fixation fasteners and a rail supported by the temporary direct fixation fasteners, and permanent anchor inserts installed through the permanent anchor insert openings in the temporary direct fixation fastener, whereby the railroad track can be placed in a fully operational state with the temporary direct fixation fasteners installed in place of the existing direct fixation fasteners after formation of holes in the substrate for the permanent anchor inserts, and a temporary positioning collar which fits with the temporary direct fixation fastener and the permanent anchor insert to position and hold the permanent anchor insert relative to the temporary direct fixation fastener and a hole in the substrate formed through permanent anchor insert openings in the temporary direct fixation fastener.

32. The system of claim 31 wherein the railroad track can be placed in a fully operation state with the temporary direct fixation fasteners installed in place of the existing direct fixation fasteners after formation of holes in the substrate for the permanent anchor inserts and after installation of the permanent anchor inserts.

33. The system of claim 32 wherein the permanent anchor inserts and temporary positioning collar are substantially flush with a top surface of the temporary direct fixation fastener when fully installed in the permanent anchor insert holes in the substrate.

34. The system of claim 31 wherein the openings in the temporary direct fixation fastener for the existing anchor studs are oversized.

35. The system of claim 31 wherein the permanent anchor insert openings in the temporary direct fixation fastener are configured as guides for a drill bit to form permanent anchor insert holes in the substrate.

36. The system of claim 31 further comprising clips engaged with the clip shoulders of the temporary direct fixation fasteners and a rail supported by the temporary direct fixation fasteners.

37. The system of claim 36 wherein the clip shoulders and clips are located proximate to the permanent anchor insert openings in the temporary direct fixation fastener.

38. The system of claim 31 further comprising an insulator between the clips and the rail.

* * * * *